US007275680B1

(12) United States Patent
Pins

(10) Patent No.: US 7,275,680 B1
(45) Date of Patent: Oct. 2, 2007

(54) ADJUSTABLE MAILBOX SUPPORT ASSEMBLY

(75) Inventor: Keith Pins, Manchester, IA (US)

(73) Assignee: Pin Industries, LLC, Manchester, IA (US)

( * ) Notice: Subject to any disclaimer, the term of this patent is extended or adjusted under 35 U.S.C. 154(b) by 43 days.

(21) Appl. No.: 11/163,042

(22) Filed: Oct. 3, 2005

(51) Int. Cl.
*A47G 29/12* (2006.01)

(52) U.S. Cl. ..... 232/39; 248/133; 248/429; 248/148; 248/156; 248/188.4; 248/545

(58) Field of Classification Search ..... 232/39; D99/32; 248/125.8, 133, 128, 429, 146, 248/148, 156, 157, 545, 188.2, 188.4, 85
See application file for complete search history.

(56) References Cited

U.S. PATENT DOCUMENTS

| | | | | | |
|---|---|---|---|---|---|
| 736,815 | A * | 8/1903 | Brown | ..... | 232/17 |
| 2,477,276 | A * | 7/1949 | Walton | ..... | 232/39 |
| 2,480,412 | A * | 8/1949 | Hubert | ..... | 248/148 |
| 2,611,570 | A * | 9/1952 | Kroll | ..... | 248/148 |
| 3,134,538 | A | 5/1964 | Fibus | | |
| 3,497,078 | A | 2/1970 | Nash | | |
| 4,186,869 | A | 2/1980 | Brown | | |
| 4,213,560 | A | 7/1980 | Hall | | |
| 4,300,739 | A | 11/1981 | Sande | | |
| 4,403,730 | A | 9/1983 | Batson | | |
| 4,496,123 | A | 1/1985 | Laramie | | |
| 4,714,192 | A | 12/1987 | Harlow, Jr. et al. | | |
| 4,930,271 | A | 6/1990 | Pizzichemi | | |
| 4,951,904 | A | 8/1990 | Obenshain | | |
| 5,065,975 | A * | 11/1991 | Giles | ..... | 248/545 |
| 5,215,283 | A | 6/1993 | Gould | | |
| 5,307,598 | A | 5/1994 | West | | |
| D376,464 | S | 12/1996 | Cunningham et al. | | |
| 5,713,514 | A * | 2/1998 | Eck | ..... | 232/39 |
| 6,161,756 | A | 12/2000 | Upton | | |
| 7,172,163 | B1 * | 2/2007 | Johnson | ..... | 248/146 |

* cited by examiner

*Primary Examiner*—William L. Miller
(74) *Attorney, Agent, or Firm*—Ryan N. Carter

(57) ABSTRACT

A mailbox assembly having a mounting plate for securing the mailbox assembly into the ground. The mounting plate has three primary configurations: a flat configuration for use on a generally flat ground surface; a bent configuration for use on the edge of a hill; and an angled configuration for use on a hill. The mailbox assembly is adjustable horizontally, vertically, pivotally, and angularly.

20 Claims, 8 Drawing Sheets

ADJUSTABLE MAILBOX SUPPORT ASSEMBLY

BACKGROUND OF THE INVENTION

The United States Postal Service provides guidelines about positioning mailboxes certain distances from the ground and certain distances away from the edge of the roadway so as to make it easier for the mail carrier to access the mailbox. These regulations have led to many inventions which disclose means for adjusting the position of a mailbox. Some of these inventions are disclosed in U.S. Pat. No. 4,403,730 (disclosing a means for adjusting the height of a mailbox), U.S. Pat. No. 6,161,756 (disclosing a means for adjusting the distance the mailbox is from the roadway), and U.S. Pat. No. 5,307,598 (disclosing a means for adjusting the angle at which the mailbox post engages the ground). One problem with the inventions disclosed in the above referenced patents is that they do not provide a sturdy platform for anchoring the mailbox into the ground when there is a hill or ditch near the roadway. In other words, the above referenced patents allow adjustment of the mailbox, but they do not take into account the unevenness of the ground on which the mailbox is situated, which is often the reason adjustments need to be made in the first place.

Another problem with conventional mailboxes is that they are not very sturdy. Often conventional mailboxes are not sturdy because the user must dig a hole in the ground to receive the mailbox post. This is time consuming and difficult for the user. Another problem with digging a hole is that the soil used to refill the hole and support the mailbox post can be loose and shift after the mailbox post is inserted into it, thereby causing the mailbox to lean or fall over.

The instability of conventional mailboxes is further demonstrated in rural areas that receive snowfall. In these areas, mailboxes are often pushed over by snowplows in the winter. Conventional mailbox posts often break when hit with a snowplow which requires the user to purchase and install a new mailbox during the cold temperatures of winter.

There is therefore a need for a mailbox with a ground engaging portion that is suitable for use on flat surfaces as well as hills. There is further a need for a mailbox that is easy to install, yet remains sturdy after it is installed. There is further a need for a mailbox having numerous adjustment means for adjusting the mailbox assembly after it has been inserted into the ground. There is further a need for a mailbox assembly that does not need to be completely replaced in the event the assembly is hit by a car or snowplow.

SUMMARY OF THE INVENTION

The present invention is an adjustable mailbox assembly having a ground engaging mounting plate with a mailbox post extending generally upwardly therefrom. The mailbox post is adapted to combine with a mailbox at its upper end. The mounting plate has a plurality of stakes extending downwardly from its lower surface. The stakes are adapted for insertion into the ground so as to secure the mounting plate to the ground. The invention comprises three different mounting plates that are each designed to be used with a specific terrain. In one embodiment, the mounting plate comprises a generally flat surface for insertion into ground that is generally flat. In a second embodiment, the mounting plate comprises a bent surface for insertion into ground on the edge of a slope or ditch. In a third embodiment, the mounting plate comprises an angled surface for insertion into sloping ground. The three mounting plates are adapted to securely hold the mailbox post at an angle that is generally perpendicular to the road surface when used on their designated type of terrain (i.e. flat, edge of hill, and hill, respectively). The adjustment features described below can be used to further adjust and/or fine tune the position of the mailbox assembly after the mounting plate has been secured into the ground.

The mailbox assembly comprises various adjustment means for adjusting the position of the mailbox (i.e. mail receiving portion). One adjustment means is a vertical adjustment wherein the post of the mailbox assembly allows adjustment in the vertical direction. Another adjustment means is a pivotal adjustment wherein the mailbox assembly allows the user to pivot the mailbox relative to the mounting plate. Yet another adjustment means is a horizontal adjustment wherein the mailbox can be adjusted horizontally. Yet another adjustment means is an angular adjustment wherein the angle that the post extends upward from the mounting plate is adjustable. In this angular adjustment means, the top portion of the mounting plate comprises several openings adapted to receive threaded connectors which are combined with the post or a flange extending from the post. The distance between the openings and the post/flange can be adjusted so that the angle the post extends upward relative to the mounting plate can be changed.

The above described adjustment features provide a mailbox with many adjustment features that can be secured into the ground regardless of whether the ground is level or hilly. The adjustment features can be employed after the stakes of the mounting plate are inserted into the ground.

DESCRIPTION OF THE PREFERRED EMBODIMENT OF THE INVENTION

Figure 1:
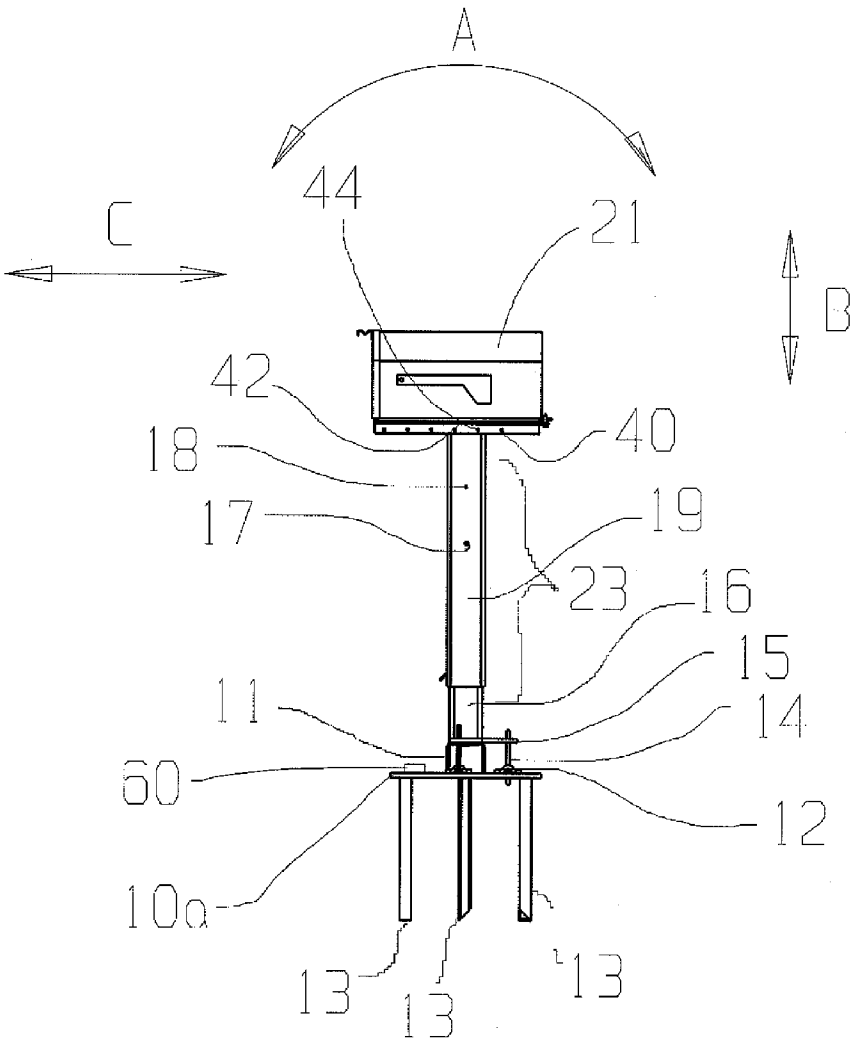
FIG. 1 is a side view of the mailbox assembly of the present invention showing the mounting plate first embodiment.
Figure 2:
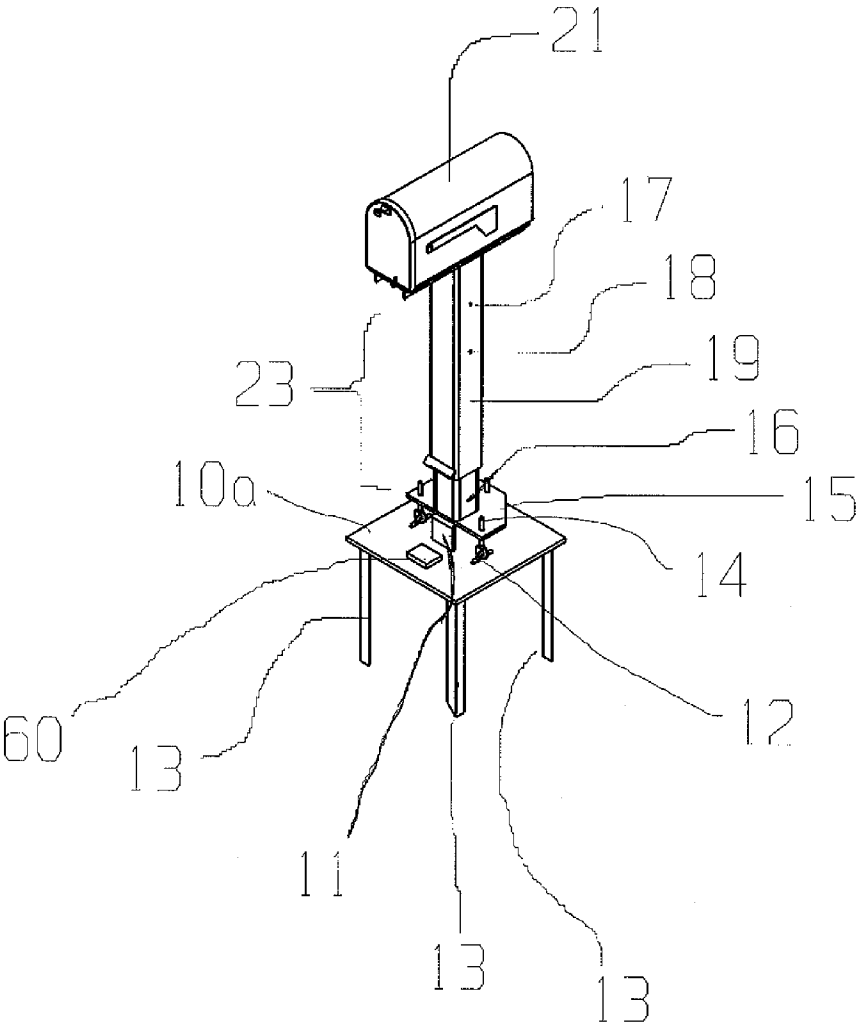
FIG. 2 is a perspective view of the mailbox assembly of the present invention showing the mounting plate first embodiment.
Figure 3:
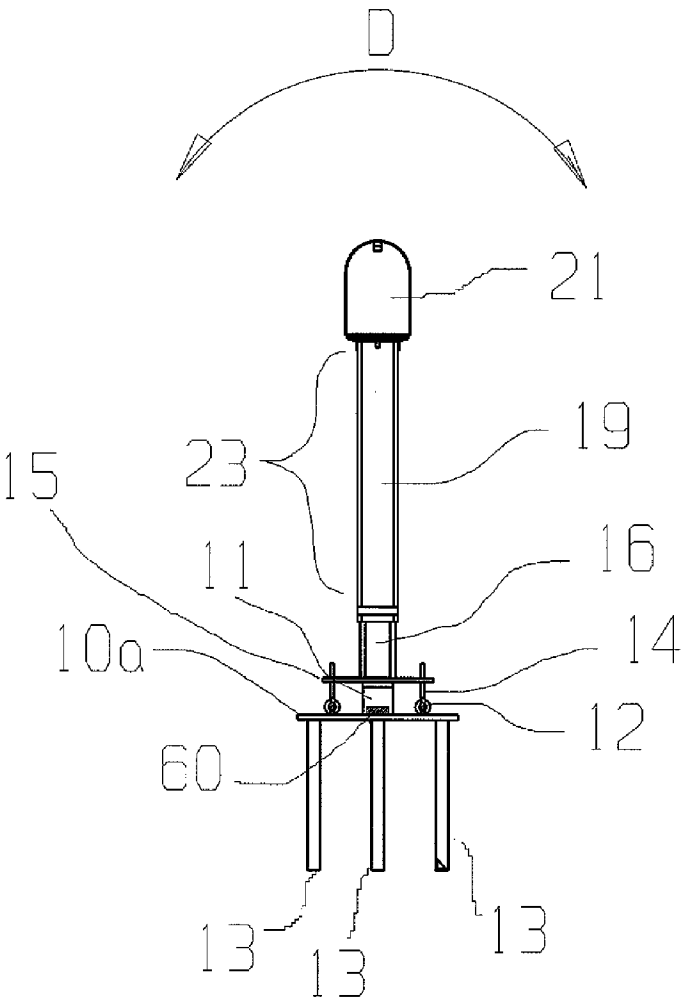
FIG. 3 is a front view of the mailbox assembly of the present invention showing the mounting plate first embodiment.

The present invention is a mailbox support assembly comprising a plurality of adjustment means for adjusting the mailbox 21 in a plurality of dimensions after the assembly is secured into the ground, regardless of whether the ground is level or hilly. FIGS. 1-3 show a first embodiment of the present invention which is adapted to support the mailbox 21 on level terrain, such as the flat grade shoulder of a road 30. This first embodiment comprises a mounting plate 10*a* that is generally flat with a post assembly 23 extending upwardly therefrom for supporting the mailbox 21 (i.e. mail receiving portion). The mounting plate 10*a* and post assembly 23 are preferably comprised of a metal or steel alloy so that they are very sturdy.

The flat mounting plate 10*a* comprises a plurality of ground engaging stakes 13 that attach to the mounting plate's 10*a* underside. The stakes 13 are adapted to be inserted into the ground to securely anchor the plate 10*a* in the level ground. Each ground-penetrating stake 13 is preferably constructed of angle iron and is combined at one end to the mounting plate 10*a* so as to remain generally parallel to the other stakes 13. Preferably, the un-welded ends of the stakes 13 comprise a pointed tip so as to permit them to be easily driven into the ground. In the preferred embodiment, these stakes 13 are attached to the ground plate 10*a* in a pattern so as to provide stability to the entire support system 20 with one stake 13 at each of the four corners of the plate 10*a* and one stake 13 centrally located.

As seen in FIGS. 1, 2 and 5-8, the top side of the mounting plate 10*a*, 10*b*, 10*c* preferably comprises a raised rubber portion called a hammer pad 60. The hammer pad 60 is adapted so that the user can use a hammer or other similar tool to pound the stakes 13 into the ground without pounding directly on the mounting plate 10*a*, which could damage the surface of the mounting plate 10*a*.

Arrows A and D in FIGS. 1 and 3, respectively, illustrate the post-angle adjustment means of the present invention. The post-angle adjustment means allows the post 16 to pivot on its base side to side as shown by arrow A in FIG. 1, and/or front to back as shown by arrow D in FIG. 3 as well as any combination of front to back and side to side. Near the center of the top side of the plate 10*a* is a post support 11. This post support 11 provides the surface upon which the post 16 rests. As seen in FIG. 2, combined with the top side of the mounting plate 10*a* are several openings 12 adapted to receive connectors 14. The connectors 14 are preferably threaded members, such as eyebolts.

As shown in FIG. 2, post assembly 23 comprises flange 15. When configured, the bottom of the post assembly 23 rests atop support 11 of the ground-engaging system and is aligned such that the openings in the post assembly's 23 flange 15 are positioned above the three openings 12 of the ground-engaging system. A first end of the connectors 14 is combined with each of the mounting plate 10*a* openings 12, while a second end of the connectors 14 is combined with the openings in the flange 15. A nut is positioned on the threaded portion of the connector 14 above the flange 15 opening so that adjusting the position of the nut on the connector 14 changes the distance between the flange 15 and the mounting plate 10*a*, which in turn changes the angle of the post assembly 23 relative to the mounting plate 10*a*.

In addition to allowing the angular adjustment of the post assembly 23, the post-angle adjustment means provides a break away point in the event the assembly is struck by a car or snowplow. In other words, if the mailbox assembly were to be hit by a car or snowplow, the connectors 14 would break before the post assembly 23 because the connectors 14 are structurally weaker than the remainder of the metal or steel alloy mailbox assembly. This connector 14 break away point is a safety feature for automobiles that may otherwise come to an abrupt and dangerous halt if they were to strike the sturdy mailbox assembly. Further, in the event the mailbox assembly was to be struck by a car or snowplow causing the connectors 14 to break and the mailbox assembly to fall over, the mailbox owner need only replace the broken connectors 14 rather than having to purchase an entire new mailbox assembly.

Arrow B in FIG. 1 illustrates the vertical adjustment means of the present invention. In the vertical adjustment means, the post assembly 23 preferably comprises an outer sleeve 19 slidably engaged with post 16 so that sleeve 19 is movable along post 16. Post 16 is combined with the ground engaging portion of the mailbox support assembly while sleeve 19 is combined with mailbox 21. Sleeve 19 comprises a plurality of fastener apertures 17 arranged in a vertical direction as seen in FIG. 1. Post 16 comprises at least one fastener aperture (not shown because it is behind sleeve 19). As such, the height of the mailbox 21 can be adjusted by sliding the sleeve post 19 over the interior fixed post 16 to the desired position, aligning the sleeve aperture 17 with an interior fastener aperture, and inserting a fastener 18 through both apertures so as to lock the outer sleeve post 19 at the desired height. As would be recognized by one of ordinary skill in the art, the plurality of apertures could be in the post 16, while the single aperture could be in the sleeve 19.

Arrow C in FIG. 1 illustrates the horizontal adjustment means of the present invention. This horizontal adjustment means is beneficial when the mail carrier needs the mailbox 21 to be adjusted toward or away from the side of the road 30. The post assembly 23 is combined with the mailbox mounting track 40 seen in FIG. 1. The mounting track 40 comprises a plurality of fastener apertures 42. The bottom side of the mailbox 21 also comprises at least one fastener aperture (not shown because they are behind the mounting track 40). The horizontal position of the mailbox 21 can be adjusted by moving the mailbox 21 relative to the mounting track 40. The mailbox 21 can be secured at its desired horizontal position by inserting a fastener 44 through the mounting track 40 apertures 42 and the apertures (not shown) on the lower portion of the mailbox 21.

Figure 4:
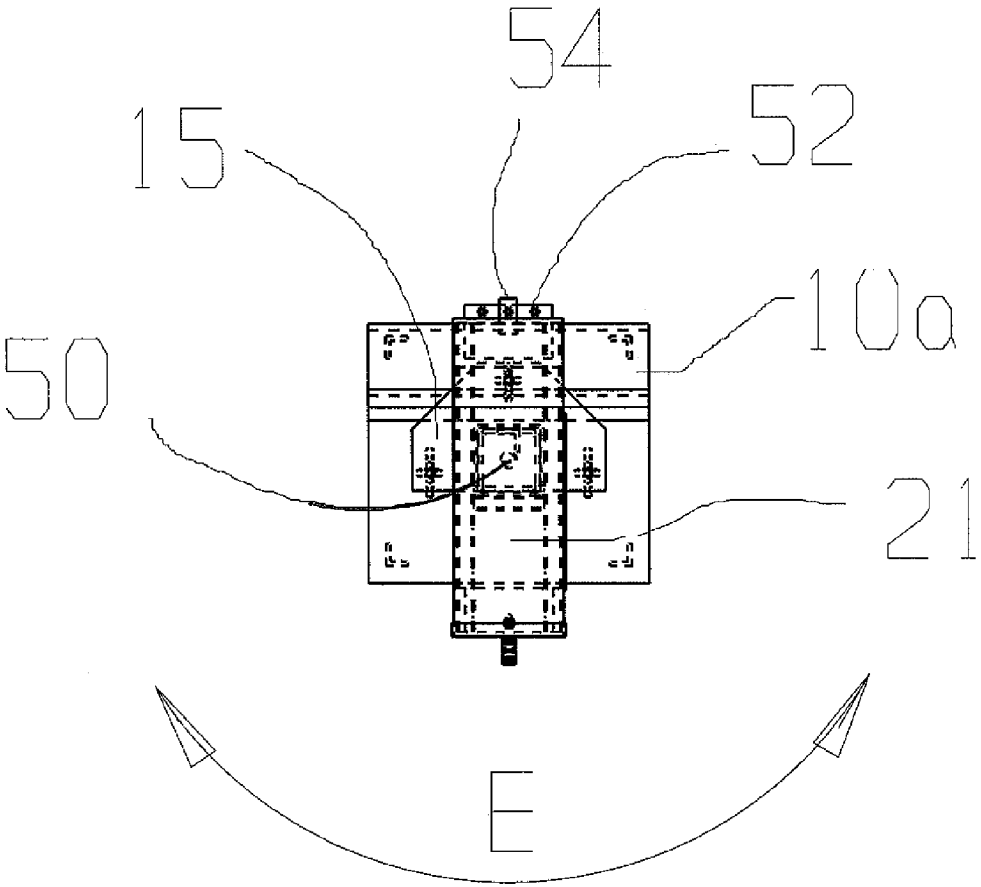
FIG. 4 is a top view of the mailbox assembly of the present invention showing the pivotal adjustment means.

Arrow E in FIG. 4 illustrates the pivotal adjustment means of the present invention. The pivotal adjustment means allows the mailbox 21 to pivot on an axis 50. As seen in FIG. 4, the rear portion of the mailbox 21 comprises a plurality of fastener apertures 52. The rear portion of the extension track 40 comprises at least one fastener aperture (not shown). The pivotal position of the mailbox 21 can be adjusted by rotating mailbox 21 on pivot point 50. The desired pivotal position of the mailbox 21 can be secured by inserting a fastener 54 through the respective aperture 52 on the rear of the mailbox 21 and through the extension track aperture (not shown).

Figure 5:
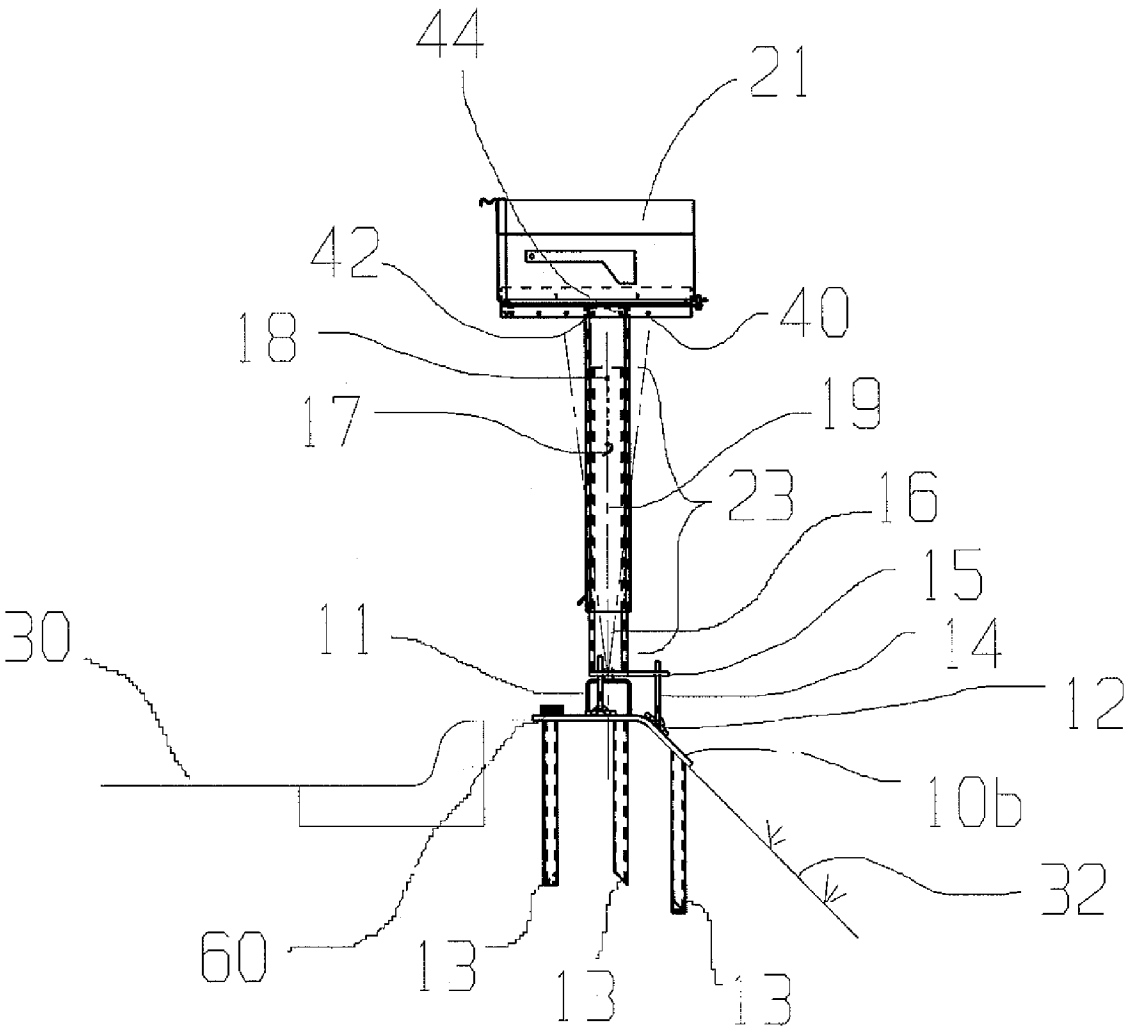
FIG. 5 is a side view of the mailbox assembly of the present invention showing the mounting plate second embodiment.
Figure 6:
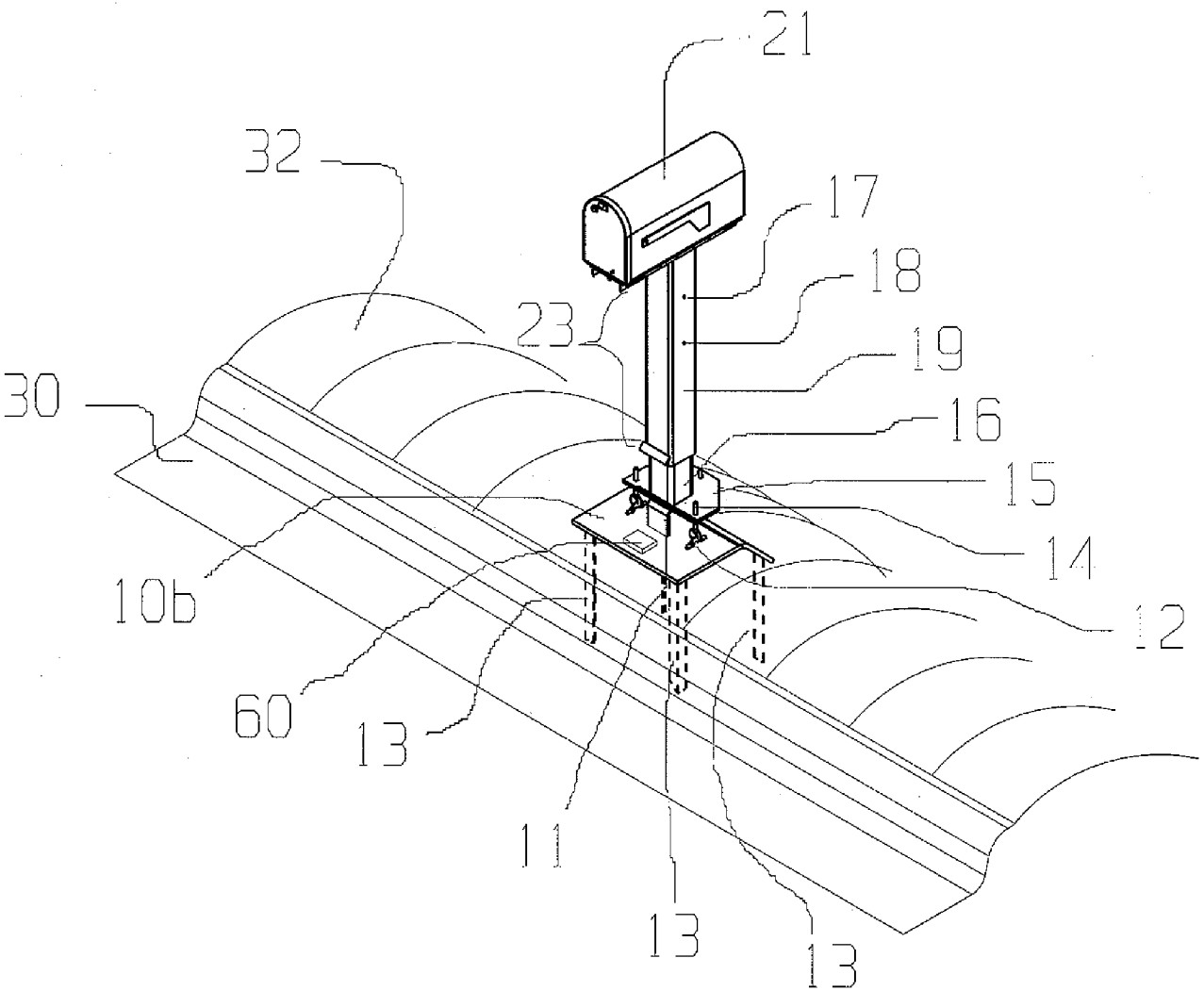
FIG. 6 is a perspective view of the mailbox assembly of the present invention showing the mounting plate second embodiment.

A second embodiment of the ground-engaging plate 10*b* is shown in FIGS. 5 and 6. The second embodiment contains all of the features of the above described first embodiment except that its mounting plate 10*b* is bent so as to securely hold the post assembly 23 perpendicular to the road 30 (not the mounting plate 10*b*) when positioned on the edge of a ditch 32 or hill. Preferably, the plate 10*b* is bent at approximately a forty-five degree angle. FIGS. 5 and 6 show the mailbox assembly positioned between the road 30 surface and a hill/ditch 32. The bent plate 10*b* allows the stakes 13 to completely enter the ground on the ditch 32 without causing the mailbox 21 to be unstable or positioned at an angle relative to the ground. In order to maintain parallelism with the vertical axis of the support system, some of the stakes 13 are combined with the ground-engaging plate 10 at an angle rather than perpendicularly as in the flat ground plate 10*a* embodiment.

Figure 7:
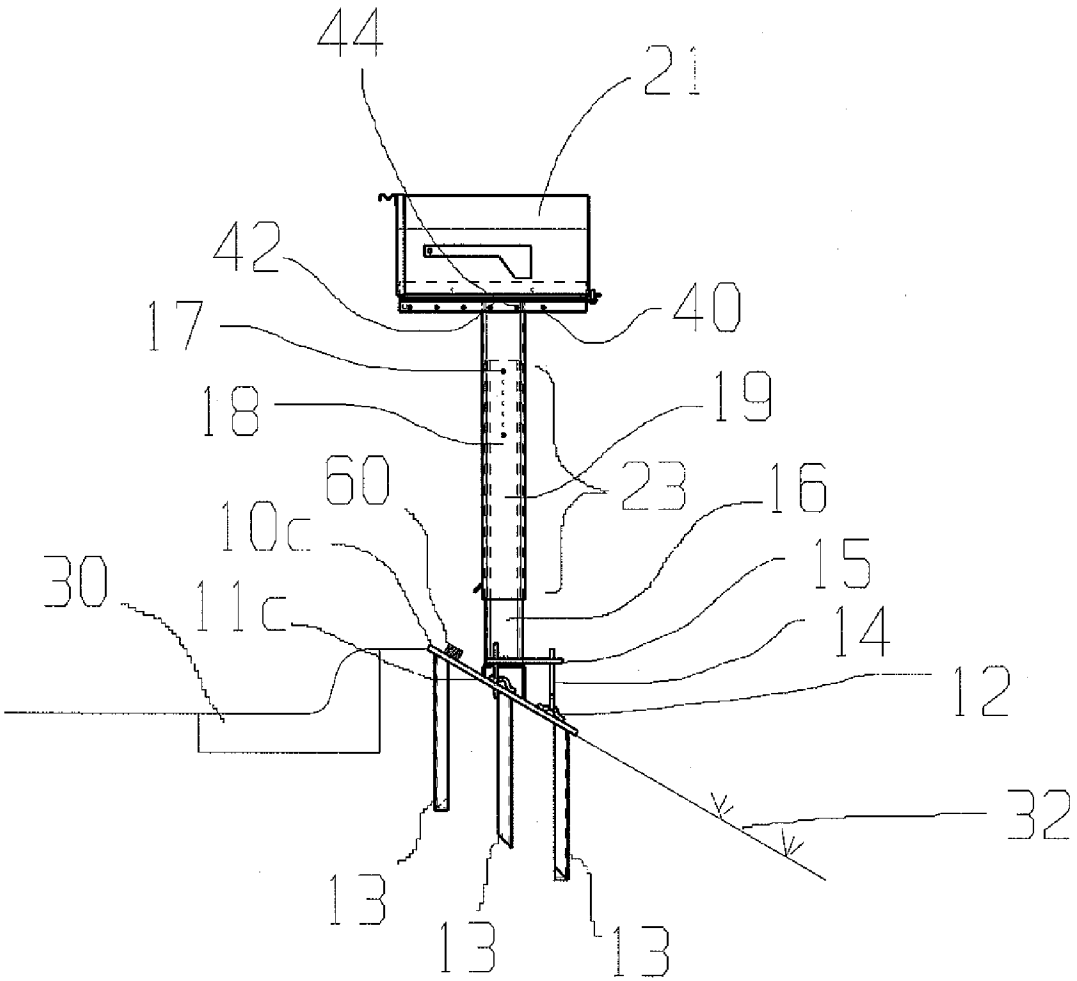
FIG. 7 is a side view of the mailbox assembly of the present invention showing the mounting plate third embodiment.
Figure 8:
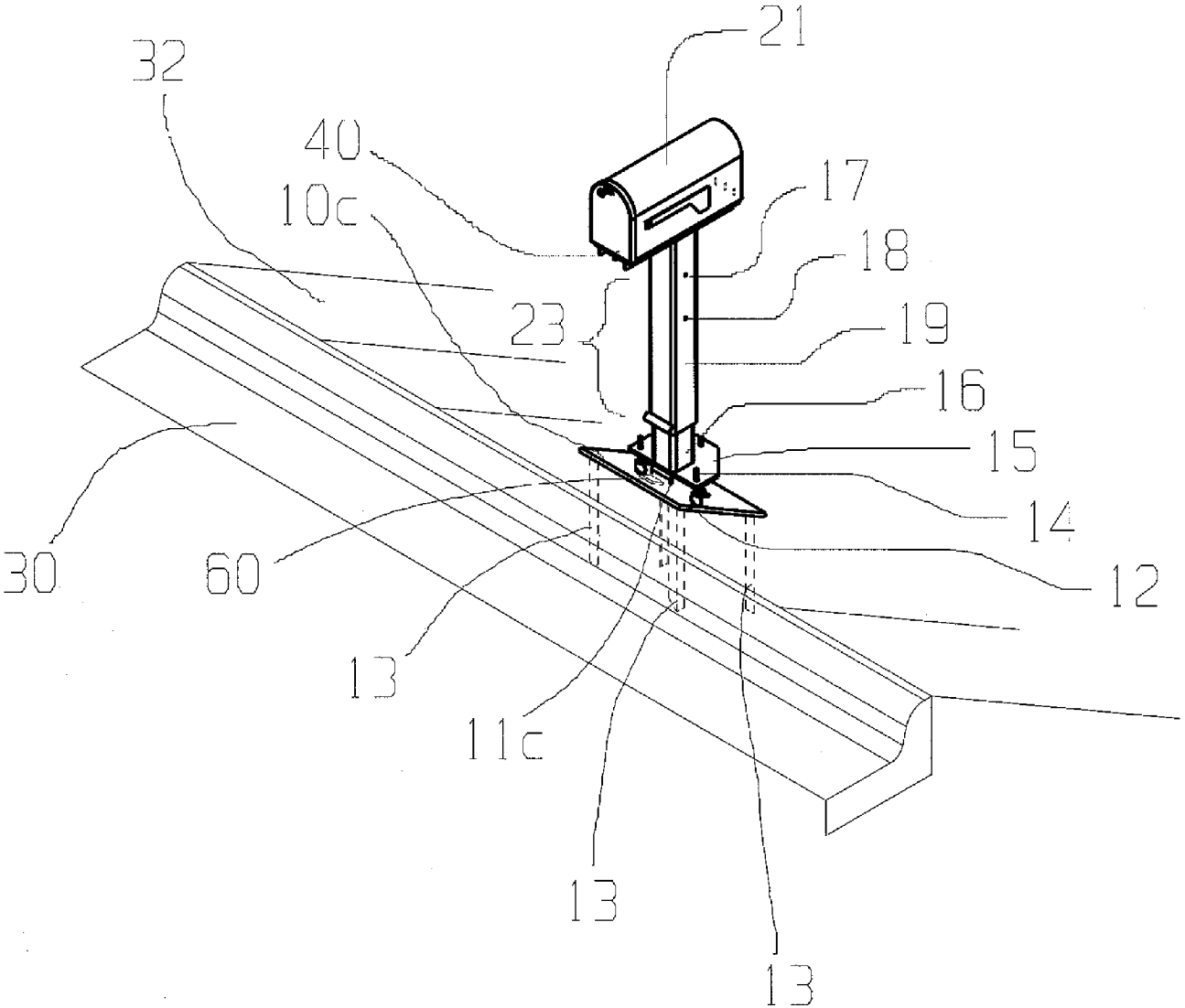
FIG. 8 is a perspective view of the mailbox assembly of the present invention showing the mounting plate third embodiment.

A third embodiment of the ground-engaging plate 10*c* is shown in FIGS. 7 and 8. The third embodiment contains all of the features of the above described embodiments except that its mounting plate 10*c* is angled so as to hold the post assembly 23 perpendicularly relative to the road 30 (not the mounting plate 10*b*) when positioned on the slope of a ditch 32 or hill. FIGS. 7 and 8 show the mailbox assembly positioned on the incline of a ditch 32 near a road 30. The angled plate 10*c* allows the stakes 13 to completely enter the sloped ground without causing the mailbox 21 to be unstable or positioned at an angle. In order to maintain parallelism with the vertical axis of the support system all of the stakes 13 are combined to the ground-engaging plate 10*c* at an angle rather than perpendicularly as in the flat ground plate embodiment. A further feature of the third embodiment is that the post support member 11*c* is shorter on the uphill side of the plate 10*c* so as to maintain the post assembly 23 at an orientation perpendicular to the vertical direction.

Having thus described the invention in connection with the preferred embodiments thereof, it will be evident to those skilled in the art that various revisions can be made to the preferred embodiments described herein with out departing from the spirit and scope of the invention. It is my intention, however, that all such revisions and modifications that are evident to those skilled in the art will be included with in the scope of the following claims.

What is claimed is as follows:

1. A mailbox support for supporting a mailbox on level terrain, said mailbox support comprising:

a mounting plate having a top surface and a bottom surface;

a plurality of stakes extending downwardly from the mounting plate bottom surface adapted for insertion into the ground;

a post assembly have a first end and a second end wherein the post assembly first end is adapted to be combined with the mailbox;

a post support in engagement with the mounting plate for supporting the post assembly a predetermined distance above the mounting plate;

at least two connectors having a first end and a second end wherein the connector first end is combined with the mounting plate and the connector second end is combined with the post assembly;

wherein the connectors are adapted to allow the distance between the mounting plate and the post assembly to change, which changes the angle of the post assembly relative to the mounting plate.

2. The mailbox support of claim 1 wherein the mounting plate further comprises a hammer pad adapted to receive strikes from a tool to pound the stakes into the ground.

3. The mailbox support of claim 1 wherein the post assembly further comprises a flange that combines with the second end of the connectors.

4. The mailbox support of claim 3 further comprising three connectors situated on different sides of the post assembly.

5. The mailbox support of claim 1 wherein the post assembly is adjustable in the vertical direction.

6. The mailbox support of claim 5 wherein the post assembly further comprises an outer sleeve slidable over an inner post for adjusting the height of the mailbox.

7. The mailbox support of claim 6 wherein the post assembly further comprises a plurality of apertures adapted to receive fasteners for securing the mailbox at its desired height.

8. The mailbox support of claim 1 further comprising a mounting track having a top side and a bottom side; wherein the mounting track bottom side is combined with the post assembly and the mounting track top side is combined with the mailbox.

9. The mailbox support of claim 8 wherein the mailbox is movable horizontally along the mounting track.

10. The mailbox support of claim 9 wherein the mounting track further comprises a plurality of apertures adapted to receive fasteners for securing the mailbox to the mounting track at its desired position.

11. The mailbox support of claim 10 wherein the mailbox is pivotally mounted to the mounting track.

12. A mailbox support for securing a mailbox on the edge of sloping ground near a roadway, said mailbox support comprising:

a bent mounting plate having a top surface, a bottom surface, a bent portion and a flat portion;

a plurality of stakes adapted for insertion into the ground, wherein some of the stakes are combined with the flat portion of the mounting plate and some of the stakes are combined with the bent portion of the mounting plate;

a post assembly have a first end and a second end wherein the post assembly first end is adapted to be combined with the mailbox; and connectors to secure the mounting plate to the post assembly second end.

13. The mailbox support of claim 12 wherein the mounting plate comprises five stakes.

14. The mailbox assembly of claim 13 wherein three of the stakes are perpendicularly combined with the flat portion of the mounting plate and two of the stakes are combined with the mounting plate bent portion; wherein the stakes combined with the mounting plate bent portion are parallel to the stakes combined with the mounting plate flat portion.

15. The mailbox assembly of claim 13 wherein three of the stakes are combined with the mounting plate flat portion and two of the stakes are combined with the mounting plate bent portion.

16. A mailbox support for securing a mailbox into sloping ground near a roadway, said mailbox support comprising:

a mounting plate having a top surface and a bottom surface;

a plurality of stakes adapted for insertion into the sloping ground, wherein the stakes extend downwardly from the mounting plate bottom surface at an angle so that as the mounting plate surface lies flush with the sloping ground the stakes are generally perpendicular to the roadway;

a post assembly have a first end and a second end wherein the post assembly first end is adapted to be combined with the mailbox; and at least two connectors having a first end and a second end wherein the connector first end is combined with the mounting plate and the connector second end is combined with the post assembly.

17. The mailbox support of claim 16 further comprising a post support in engagement with the mounting plate for supporting the post assembly a predetermined distance above the mounting plate.

18. The mailbox support of claim 17 wherein the post support has an uphill end and a downhill end; wherein the distance between the mounting plate and the post support downhill end is larger than then distance between the mounting plate and the post support uphill end so that the post support is able to hold the post assembly generally perpendicular to the roadway.

19. The mailbox support of claim 16
wherein the connectors are adapted to allow the distance between the mounting plate and the post assembly to change, which changes the angle of the post relative to the mounting plate.

20. The mailbox support of claim 16 wherein the mounting plate further comprises a hammer pad adapted to receive strikes from a tool to pound the stakes into the ground.

* * * * *